US005245933A

United States Patent [19]

Childs

[11] Patent Number: 5,245,933

[45] Date of Patent: Sep. 21, 1993

[54] HEAT AND SMOKE REMOVER

[75] Inventor: Henry T. Childs, Chattanooga, Tenn.

[73] Assignee: Temperature Adjusters, Inc., Chattanooga, Tenn.

[21] Appl. No.: 809,308

[22] Filed: Dec. 19, 1991

Related U.S. Application Data

[63] Continuation-in-part of Ser. No. 685,551, Apr. 15, 1991, abandoned.

[51] Int. Cl.[5] ..... F23B 5/00

[52] U.S. Cl. ..... 110/214; 29/890.08; 60/273; 60/303; 422/168; 431/5

[58] Field of Search ..... 431/5, 202; 110/212, 110/213, 214; 422/168; 98/119, 60; 181/265, 256; 29/890.08; 60/273, 303

[56] References Cited

U.S. PATENT DOCUMENTS 3,073,684 1/1963 Williams, Sr. ..... 431/5 X 3,930,802 1/1976 Beasley et al. ..... 431/202 X 4,336,017 6/1982 Desty ..... 431/202

*Primary Examiner*—Edward G. Favors

[57] ABSTRACT

This invention relates to a method and apparatus for the extraction of smoke from the exhaust gases of an internal combustion of fuel in a mechanical device. It also relates to the extraction of heat from such exhaust gases. The apparatus is positioned to accept the flow of the device's hot exhaust gases through its insulated chambers and is sized to allow sufficient time of exposure of said hot exhaust gases to the high temperatures held within said chambers. The high temperatures are augmented by a heating element and the introduction of additional outside air at a venturi tube located near the entrance of the apparatus. Thus the apparatus holds the exhaust gases long enough inside its sufficiently oxidized chambers under sufficiently high temperatures to burn all the smoke particles in said exhaust gases.

16 Claims, 2 Drawing Sheets

Fig. 1
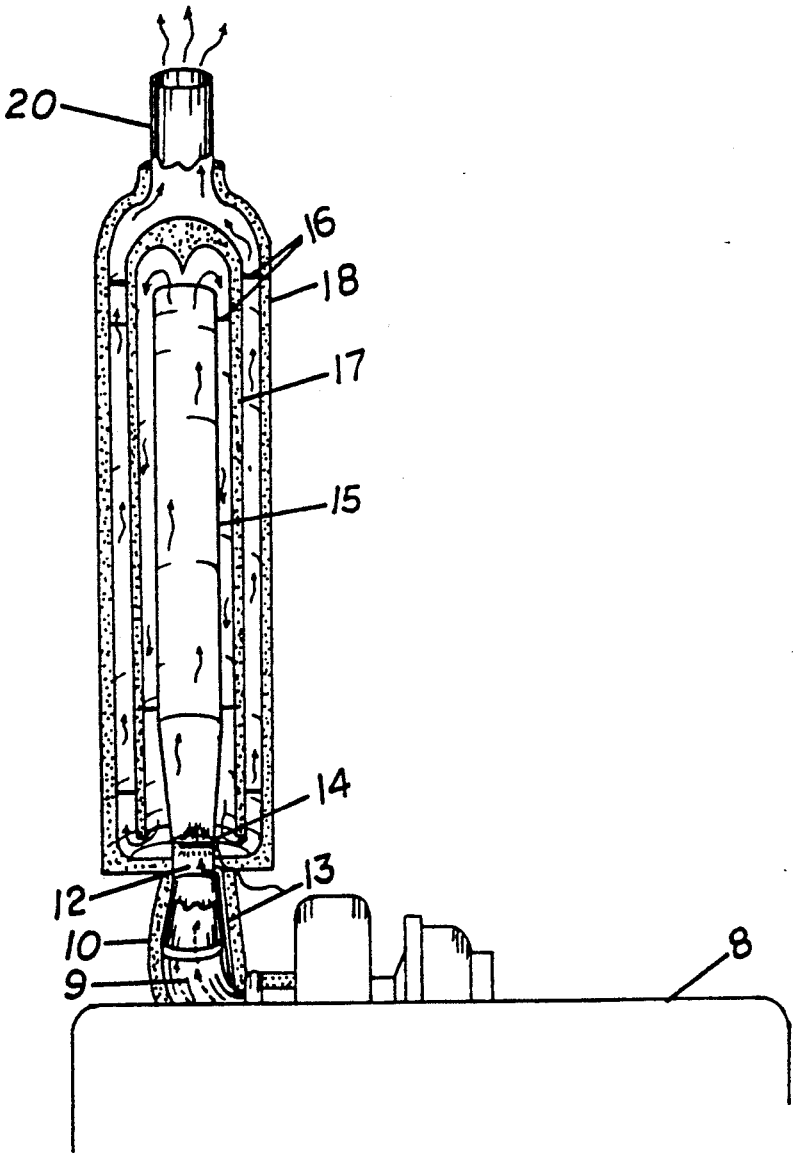
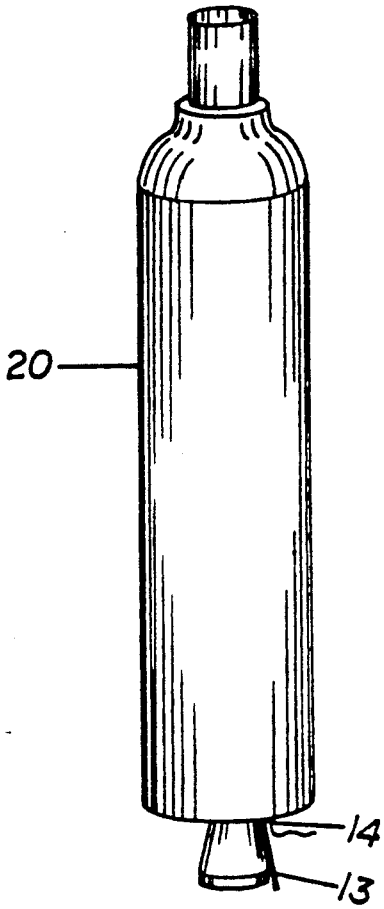
Fig. 2

Fig. 3
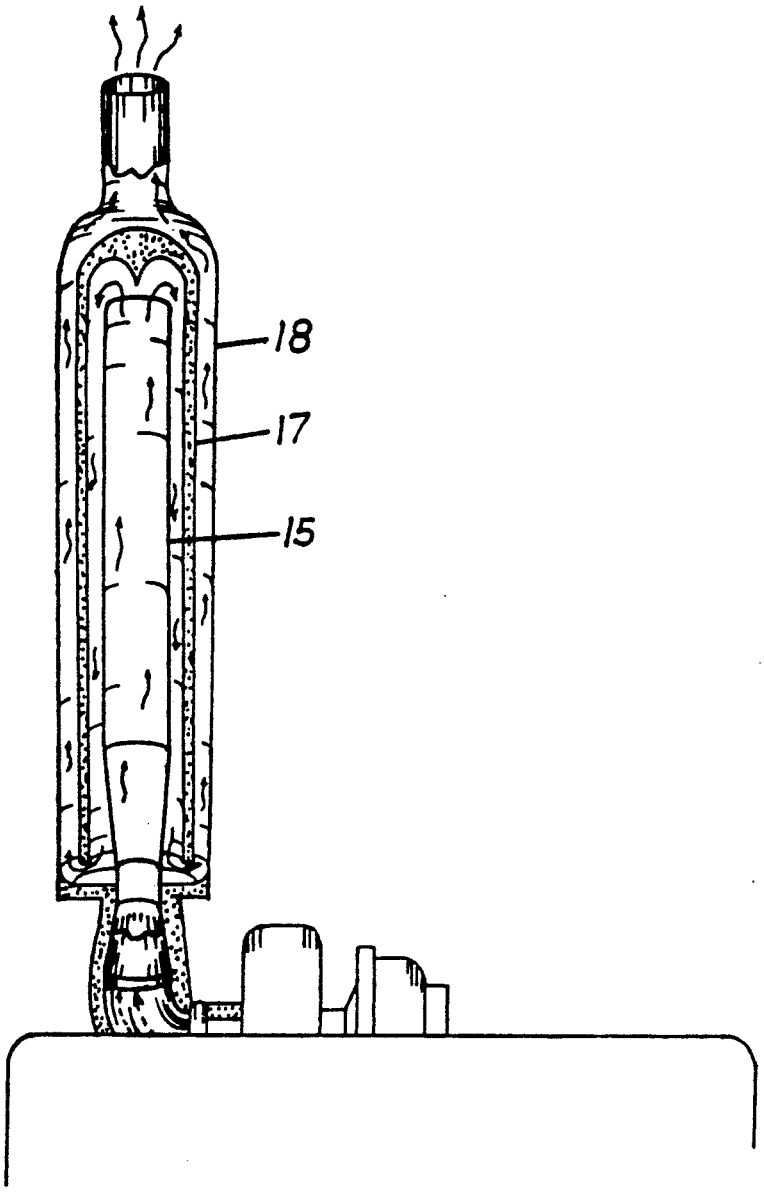
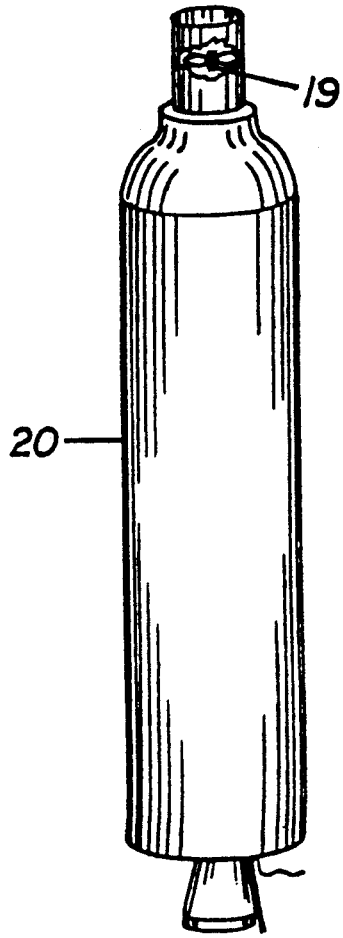
Fig. 4

HEAT AND SMOKE REMOVER

RELATED U.S. APPLICATION DATA

Continuation-in-part of Ser. No. 07/685,551 filed Apr. 15, 1991 abandoned.

CITED REFERENCES OF U.S. PATENT DOCUMENTS

| | | | |
|---|---|---|---|
| 2,640,557 | 6-1953 | Gaffney | 181/265 |
| 3,662,669 | 5-1972 | Cullinane, Jr. | 98/60 |
| 3,055,417 | 9-1962 | Reed | 98/60 |
| 1,514,441 | 11-1924 | Culp | 181/265 |
| 4,831,941 | 5-1989 | Childs | 110/317 |

BACKGROUND OF THE INVENTION

The pollution of our air by impurities exhausted from the internal combustion of fuels in a mechanical device, such as a diesel engine, is a world wide problem, as such contributes to the cause of severe damage to health, wild life and vegetation. This invention contributes to the elimination of this pollution problem as it contributes to extracting smoke particles from the internal combustion of fuels in a mechanical device.

SUMMARY OF THE INVENTION

The purpose of this invention is to provide an inexpensive, trouble free method of extracting impurities and/or heat from the exhaust gases of the internal combustion of fuels in a mechanical device, such as a diesel engine. The flexible design allows adjustment in height and width to accommodate various volumes of exhaust gases so that said gases can linger sufficiently in time within the oxidized high temperatures, thus burning the smoke particles and exhausting clean gases.

Various other features of the method and apparatus of the present invention will become obvious to those skilled in the art upon reading the disclosure set forth hereinafter.

BRIEF DESCRIPTION OF DRAWINGS

Referring now to the drawings, the apparatus is shown in a cut-a-way view attached to the exhaust of a diesel engine and as a portable unit.

FIG. 1 illustrates the apparatus in a cut-a-way view with arrows showing the gas flow through said apparatus.

FIG. 2 illustrates the apparatus as it would be prior to installation.

FIG. 3 illustrates the apparatus in a cut-a-way view for extracting heat and smoke from exhaust gases.

FIG. 4 illustrates the apparatus with a induced draft fan.

DETAILED DESCRIPTION

Referring now to FIGS. 1 and 2, there are illustrations showing a cut-a-way view of the apparatus 20 and the outer view of said apparatus 20. FIG. 1 shows said apparatus 20 in a vertical position, attached to the exhaust of a diesel engine 8 at exhaust pipe 9, which is sufficiently insulated 10, to prevent heat loss from the exhaust gases prior to entering said apparatus 20. Center pipe 15 has its open protruding end connected to the engine exhaust and contains a venturi pipe section 12. Said venturi section of pipe 12 contains a fresh air pipe 13, that allows fresh outside air to be drawn into the diesel exhaust gas stream. The fresh air pipe 13 can be extended in a selected position against the hot side of the diesel engine so its outside air will be preheated, as it is drawn into the exhaust gases. Additional heat is applied to the exhaust gases by at least one glow type heating element 14 selectively located downstream from the fresh air entrance pipe 13 inside center pipe 15. Combustibles unburned in said exhaust gases will be ignited by the heating element, thus increasing the temperature of the exhaust gases to well above the ignition point of the smoke particles floating in the exhaust gases. Telescoping over the upper open end of center pipe 15, that is furthest from the venturi area, is a selectively insulated tube 17, having its upper end closed and supported by support posts 16, and is selectively aligned and sized so that allotted air space will exist between its inside walls and top and the outside walls and open end of center pipe 15, and sufficient in length to allow an allotted portion of the sized pipe to protrude beyond said selectively insulated tube's open end. Said insulated tube 17, holding high temperatures inside its walls and top and inside the center pipe 15, provide an extended route for the engine exhaust gases to travel, thus increasing the burn time for the smoke particles. Installed over insulated tube 17, and its protruding end of center pipe 15, is a larger selectively insulated cover pipe 18, having one closed end, with the protruding end of the sized pipe 15 installed to extend an allotted distance through the closed end of said larger selectively insulated cover pipe 18, said cover pipe 18 positioned so that its inside walls are selectively aligned with the outside walls of the selectively insulated tube 17 and being sufficient in size to allow allotted air space to exist between their aligned walls and ends, with said selectively insulated cover pipe 18 being sufficient in length to extend an allotted distance beyond the closed end of the selectively insulated tube 17, with said cover pipe's open end that protrudes beyond the insulated tube 17 then adjusted in diameter to a selected dimension, with at least two methods of adjustment being by crimping for size reduction, or by notching and welding, thus establishing a passageway for the exhaust gases to pass through said apparatus. Insulated cover pipe 18 is held in place by support posts 16, and by being insulated, continues to hold the high temperatures within the exhaust gases and supplies an additional extended route for the engine exhaust gases to travel, thus allowing more burn time for the exposed smoke particles. The volume size of center pipe 15, which is its length and diameter, and which influences the overall size of the apparatus, is selectively determined by the exhaust gas flow rate needed and the burn time needed to burn the smoke particles from the exhaust gases.

FIG. 2 illustrates the apparatus prior to its installation and shows fresh air pipe 13 and the servicing wire to heating element 14.

FIG. 3 illustrates a cut-a-way view of the apparatus showing no insulation on the outer cover 18, thus heat is extracted from the outer cover for use elsewhere. With tube 17 insulated, smoke particles are burned as the exhaust gases travel through center pipe 15, and down through tube 17, after which heat is then given off by cover pipe 18, as the exhaust gases pass inside.

FIG. 4 illustrates the outside view of the apparatus showing a cut-a-way view of an induced draft fan 19 for needed draft.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. A method of removing smoke particles from the exhaust gases of an internal combustion of fuel in a mechanical device, comprising the steps of a. having a sized pipe with open ends and containing a selectively positioned constriction or venturi area, b. telescoping over the end of said sized pipe that is furthest from the venturi area, a larger, selectively insulated tube, having only one open end and held in place by means for support and spacing, and positioned so that its walls are selectively aligned with the sized pipe walls and being sufficient in size to allow allotted air space to exist between their aligned walls and their enclosed and open ends, and sufficient in length to allow an allotted portion of the sized pipe to protrude beyond said selectively insulated tube's open end, c. telescoping over the protruding end of the sized pipe and over its capping selectively insulated tube, a larger selectively insulated cover pipe, having one closed end, with the protruding end of the sized pipe installed to extend an allotted distance through the closed end of said larger selectively insulated cover pipe, said cover pipe held in place by means for support and spacing, d. positioning the selectively insulated cover pipe so that its inside walls are selectively aligned with the outside walls of the selectively insulated tube, and being sufficient in size to allow allotted air space to exist between their aligned walls and ends, with said selectively insulated cover pipe being sufficient in length to extend an allotted distance beyond the closed end of the selectively insulated tube, with its inside diameter then adjusted to a selected dimension, thus establishing a passageway for the exhaust gases to pass through the apparatus, e. installing means of attaching the protruding end of the sized pipe to the exhaust of said mechanical device.

2. The method in claim 1 and further comprising the steps of a. positioning through the wall of the venturi area of the sized pipe, a selectively sized tube for delivering outside fresh air into the sized pipe.

3. The method in claim 1 and further comprising the steps of a. installing at least one heating element, with means for producing heat, selectively positioned inside the sized pipe.

4. The method in claim 1 and further comprising the steps of a. installing means for supplying needed draft through said apparatus.

5. The method in claim 2 and further comprising the steps of a. installing at least one heating element, with means for producing heat, selectively positioned inside the sized pipe.

6. The method in claim 5 and further comprising the steps of a. installing means for supplying needed draft through said apparatus.

7. A method of removing heat and smoke particles form the exhaust gases of an internal combustion of fuel in a mechanical device, comprising the steps of a. having a sized pipe with open ends and containing a selectively positioned constriction or venturi area, b. telescoping over the end of said sized pipe that is furthest from the venturi area, a larger, selectively insulated tube, having only one open end and held in place by means for support and spacing, and positioned so that its walls are selectively aligned with the sized pipe walls and being sufficient in size to allow allotted air space to exist between their aligned walls and their enclosed and open ends, and sufficient in length to allow an allotted portion of the sized pipe to protrude beyond said selectively insulated tube's open end, c. telescoping over the protruding end of the sized pipe and over its capping selectively insulated tube, a larger cover pipe, having one closed end, with the protruding end of the sized pipe installed to extend an allotted distance through the closed end of said larger cover pipe, said cover pipe held in place by means for support and spacing, d. positioning the cover pipe so that its inside walls are selectively aligned with the outside walls of the selectively insulated tube, and being sufficient in size to allow allotted air space to exist between their aligned walls and ends, with said cover pipe being sufficient in length to extend an allotted distance beyond the closed end of the selectively insulated tube, with its inside diameter than adjusted to a selected dimension, thus establishing a passageway for the exhaust gases to pass through said apparatus, e. installing means of attaching the protruding end of the sized pipe to the exhaust of said mechanical device.

8. The method in claim 7 and further comprising the steps of a. positioning through the wall of the venturi area of the sized pipe, a selectively sized tube for delivering outside fresh air into the sized pipe.

9. The method in claim 7 and further comprising the steps of a. installing at least one heating element, with means for producing heat, selectively positioned inside the sized pipe.

10. The method in claim 7 and further comprising the steps of a. installing means for supplying needed draft through said apparatus.

11. The method in claim 8 and further comprising the steps of a. installing at least one heating element, with means for producing heat, selectively positioned inside the sized pipe.

12. The method in claim 11 and further comprising the steps of a. installing means for supplying needed draft through said apparatus.

13. An apparatus for removing smoke particles from the exhaust gases of an internal combustion of fuel in a mechanical device, comprising a. a sized pipe with open ends and containing a selectively positioned constriction or venturi area, b. at least one heating element with means of producing heat, selectively installed inside the sized pipe, c. a larger selectively insulated tube, having only one open end, telescoped over the end of said sized pipe that is furthest from the venturi area and held in place by means for support and spacing, and positioned so that its walls are selectively aligned with the sized pipe walls and being sufficient in size to allow allotted air space to exist between their aligned walls and their enclosed and open ends, and sufficient in length to allow an allotted portion of the sized pipe to protrude beyond said selectively insulated tube's open end, d. a larger selectively insulated cover pipe, having one closed end, telescoped over the protruding end of the sized pipe and over its capping selectively insulated tube, with the protruding end of the sized pipe installed to extend an allotted distance through the closed end of said larger selectively insulated cover pipe, said cover pipe being held in place by means for support and spacing, e. the selectively insulated cover pipe positioned so that its inside walls are selectively aligned with the outside walls of the selectively insulated tube, and of sufficient size to allow allotted air space to exist between their aligned walls and ends, with said selectively insulated cover pipe being sufficient in length to extend an allotted distance beyond the closed end of the selectively insulated tube, with its inside diameter than adjusted to a selected dimension, thus establishing a passageway for the exhaust gases to pass through said apparatus, f. means of attaching the protruding end of the sized pipe to the exhaust of said mechanical device.

14. The apparatus in claim 13 and further comprising a. a selectively sized tube installed through the wall of the venturi area of the sized pipe for delivering outside fresh air into the sized pipe.

15. The apparatus in claim 13 and further comprising a. means for supplying needed draft through said apparatus.

16. The apparatus in claim 14 and further comprising a. means for supplying needed draft through said apparatus.

* * * * *